US006612629B2

(12) United States Patent
O'Hanlon

(10) Patent No.: US 6,612,629 B2
(45) Date of Patent: Sep. 2, 2003

(54) SPRING BOLT AND STRIKE PLATE GUARD

(76) Inventor: Edward O'Hanlon, 3268 E. 26th St., Tucson, AZ (US) 85713

( * ) Notice: Subject to any disclaimer, the term of this patent is extended or adjusted under 35 U.S.C. 154(b) by 0 days.

(21) Appl. No.: 09/973,545

(22) Filed: Oct. 9, 2001

(65) Prior Publication Data

US 2003/0067177 A1 Apr. 10, 2003

(51) Int. Cl.[7] ..... E05B 17/00

(52) U.S. Cl. ..... 292/346; 292/DIG. 55; 292/DIG. 2; 70/416; 70/417; 70/418

(58) Field of Search ..... 292/346, DIG. 55, 292/DIG. 2, 340, 341.12, 341.14, 288, 289; 70/416, 417, 418

(56) References Cited

U.S. PATENT DOCUMENTS

| | | | | | |
|---|---|---|---|---|---|
| 2,370,781 | A | * | 3/1945 | Cullum | 292/346 |
| 3,825,291 | A | * | 7/1974 | Sprunger | 292/346 |
| 3,826,526 | A | * | 7/1974 | Wepsala, Jr. | 292/340 |
| 4,005,890 | A | * | 2/1977 | Murch | 292/340 |
| 4,017,106 | A | * | 4/1977 | Salazar | 292/340 |
| 4,130,311 | A | * | 12/1978 | Sushan | 292/346 |
| RE31,276 | E | * | 6/1983 | Schlage | 292/340 |
| 4,505,504 | A | * | 3/1985 | Matzkin et al. | 292/337 |
| 4,522,048 | A | * | 6/1985 | Davis | 70/381 |
| D283,299 | S | * | 4/1986 | Mazie | 292/340 |
| 4,629,231 | A | * | 12/1986 | Bouchard | 292/340 |
| 4,832,386 | A | * | 5/1989 | Sweet | 292/264 |
| 4,865,370 | A | * | 9/1989 | Francis | 292/340 |
| 4,986,585 | A | * | 1/1991 | Panter et al. | 292/346 |
| 5,094,489 | A | * | 3/1992 | Jones | 292/340 |
| 5,193,867 | A | * | 3/1993 | Husted | 292/288 |
| 5,415,020 | A | * | 5/1995 | Allenbaugh | 70/417 |
| 5,704,666 | A | * | 1/1998 | Guillemette | 292/340 |
| 6,390,515 | B1 | * | 5/2002 | Huang | 292/169.14 |
| 6,406,076 | B1 | * | 6/2002 | Zarzycki, Jr. | 292/346 |

* cited by examiner

*Primary Examiner*—Robert J. Sandy
*Assistant Examiner*—Matthew E. Rodgers

(57) ABSTRACT

As herein described a plastic or metal hollow frame device which when mounted within the bolt cavity on a door frame and therefrom extending outwards with curved 'U' shaped arms through the strike plate aperture mounted concentric with and above the said frame bolt cavity, and thence into the space between the door frame and the edge of the closed door, i.e. the door gap, upon which door is mounted an associated spring bolt door lock, in such a manner that when the spring bolt is located within the strike plate aperture and the frame bolt cavity, i.e. the door is closed, the said spring bolt is protected on three sides by the curved 'U' shaped arms such that all methods of attacking the spring bolt by any external means are effectively blocked, and additionally, wherein the said 'U' shaped curved arms bear upon the strike plate aperture such that any impact force on the outside surface of the door is redirected into the door cripple by the bending of the 'U' shaped curved arms on to the hollow frame base plate, thus dissipating the impact force at right angles to the direction of the initial impact force rather than the retaining screws of the strike plate, thus maintaining the integrity of the spring bolt and also the frame strike plate in a manner which designates its explicit naming as a spring bolt and strike plate guard.

3 Claims, 3 Drawing Sheets

SPRING BOLT AND STRIKE PLATE GUARD

BACKGROUND OF THE INVENTION

Spring bolt door locks are the most widely used locks because they provide ease of entry and exit without the use of a key. However, in their locked condition, when a key is required to open the door from the outside of the premises, other methods can be used to overcome the security provided by the lock. These methods include the use of a plastic card, such as a credit card, or a metal shim, which item is inserted into the gap between the strike plate on the door frame and the lock housing mounted on the door and which said item is then brought to bear upon the sloped side of the spring bolt in such a manner that when the plastic card, or metal shim, is pushed further into the door gap the spring of the spring bolt is overcome thus causing the spring bolt to exit from the strike plate cavity and force it back into the lock housing on the door. In this way the door can be readily opened without the use of a key and so the security provided by the lock has been overcome.

A sring bolt and strike plate guard made in accordance with this invention will prevent the spring bolt from being forced out of the strike plate cavity and into the lock housing by any external means, other than the key, and will thus increase the security of the spring bolt to that of a dead bolt, and yet maintain the convenience of the spring bolt lock.

A second method of attack upon the door is kicking or barging the door about a foot above the lock. This action causes the door to bend about the lock bolt which generates a twisting force, or torque, which concentrates the impact on the upper retaining screw of the strike plate. Without the the spring bolt and strike plate guard being installed the applied torque is usually sufficient to cause the upper retaining screw to migrate through the frame closely followed by the lower retaining screw and thus dislodge the strike plate. With the srping bolt and strike plate guard mounted within the bolt cavity the torque force first strikes the 'U' shaped frame causing it to try to bend within the bolt cavity. This bending motion causes the curved 'U' arms of the spring bolt and strike plate guard to bear upon its mounting base plate thus redirecting the lateral primary torque, through a 90° directional change, into the door frame and cripple and so dissipating the torque force within the door cripple rather than the strike plate, thus maintaining the strike plate integrity.

A spring bolt and strike plate guard made in accordance with this invention will prevent the strike plate from ripping out of the door frame under external impact forces and so will increase the security provided by the strike plate and door lock combination.

SUMMARY OF THE INVENTION

The spring bolt and strike plate guard consista of a 'U' shaped plastic or metal hollow frame cut to such a length that it includes three dimensions. These dimensions being, in the first instance, the depth ofthe bolt cavity cut into the door frame into which the spring bolt and strike plare guard will be mounted. In the second instance, it is that distance between the bolt strike plate mounted on the door frame, above the bolt cavity, and the lock mounting plate on the door edge, this distance being designated as the door gap. And, in the third and final instance, a base plate by which the spring bolt and strike plate guard is mounted within the bolt cavity, this base plate being formed by removing the curved side arms of the 'U' shaped hollow frame just beyond the distance required in the first two aforesaid instances, such that a flate base, made up of the base of the 'U' of the 'U' shaped hollow frame, is formed, which flat base is bent inwards towards the remaining sides of the 'U' shaped hollow frame to further form a flat base section which is used to mount the spring bolt and strike plate guard to the bottom of the bolt cavity by means of a wood screw inserted through a hole drilled in this flat base section.

Thus, when this spring bolt and strike plate guard, as described above, is placed into the said bolt cavity on the door frame, such that the flat base section bears upon the bottom of the cavity, and the base of the 'U' shape bears upon the outermost edge of the strike plate aperture, that is the edge closest to the outside of the door, and the curved 'U' arms bear upon the upper and lower edges of the strike plate aperture, and is then screwed in place by means of the wood screw through the said flat base plate hole, a section of the 'U' shaped hollow frame will protrude out from the strike plate and into the free space of the door gap. This protruding section envelopes most of the sloping, or cammed, section of the spring bolt, which is the outermost part of the spring bolt, and thus prevents any external body inserted into the door gap reaching the spring bolt.

Since the protruding section of the spring bolt and strike plate guard should fill most of the door gap, and since each door gap may be different, the protruding 'U' section must be capable of being varied in its length of protrusion. This variation in protrusion length is accomplished by either filing or grinding the protrusion such that it allows free movement of the door.

Further, since the protruding section of the 'U' shaped hollow frame bears upon the strike plate aperture,any impact force applied to the outside of the door, in an attempt to break the strike plate free of the door frame, and thus allow the door to open, is blocked from acting on the strike plate by the said protrusion absorbing the impact and redirecting the impact force into the door frame and cripple, where it is dissipated.

An object of this invention is the provision of a spring bolt and strike plate guard which will fill the gap between the door frame and the door edge in such a manner that the sloping, or cammed, surface of a spring bolt lock is protected in all dimensions from any external body inserted into the said door gap.

An object of this invention is the provision of a spring bolt and strike plate guard which can be adjusted such that variations in door installations, such as bolt cavity depth and door gap width, can be compensated for.

An object of this invention is the provision of a spring bolt and strike plate guard which will dissipate or deflect, through a 90° directional change, any force applied by some external body to the outside of a door, such that the integrity of the strike plate is maintained.

An object of this invention is the provision of a spring bolt and strike plate guard which can be used on any type of door which employs a spring bolt lock.

An object of this invention is the provision of a spring bolt and strike plate guard which is screwed to the bottom of a bolt cavity and thus inhibits tampering with the device.

The above stated and other objects and advantages of the invention will become apparent from the following description when taken with the accompanying drawings and descriptions. It will be understood, however, that the drawings are for purposes of illustration and are not to be construed as defining the scope or limits of the invention, references being had for the latter purpose to the claims appended hereto.

BRIEF DESCRIPTION OF THE DRAWINGS

In the drawings wherein like reference charachters denote like parts in the several views.

DESCRIPTION OF THE PREFERRED EMBODIMENT

Figure 1:
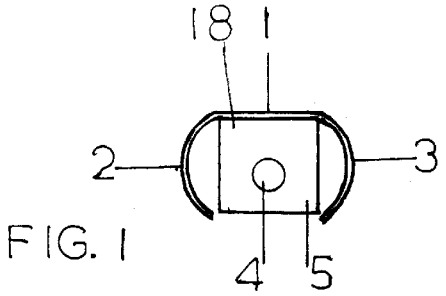
FIG. 1. Is a plan view of the spring bolt and strike plate guard.

Referring to FIG. 1, the front plate (1) forms the base of the 'U' in the 'U' shaped hollow frame and the side plates, or flanges, (2) and (3) form the curved arms of the 'U' in the hollow frame. The base of the spring bolt and strike plate guard (5) is formed by cutting off the side arms of the 'U' (2) and (3) at some distance along their length leaving a flat section (5) which is then bent inwards towards the side arms of the 'U' (2) and (3) such that it forms the base (5) of the spring bolt and strike plate guard (18). A hole (4) is drilled into this base (5) through which screw (19) is inserted (see FIG. 5) which screw (19) is used to attach the spring bolt and strike plate guard (18) to the bottom of the bolt cavity cut into the door frame.

Figure 2:
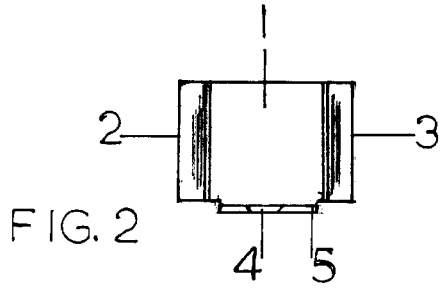
FIG. 2. Is an elevation view of the spring bolt and strike plate guard.

FIG. 2, shows a side elevation of the spring bolt and strike plate guard (18) the side arms (2) and (3) of which are cut to a length such that they include the average depth of the spring bolt cavity (7) cut into the door frame plus the distance between the strike plate mounted on the door frame and the lock mounting plate on the door edge, nominally the door gap.

Figure 3:
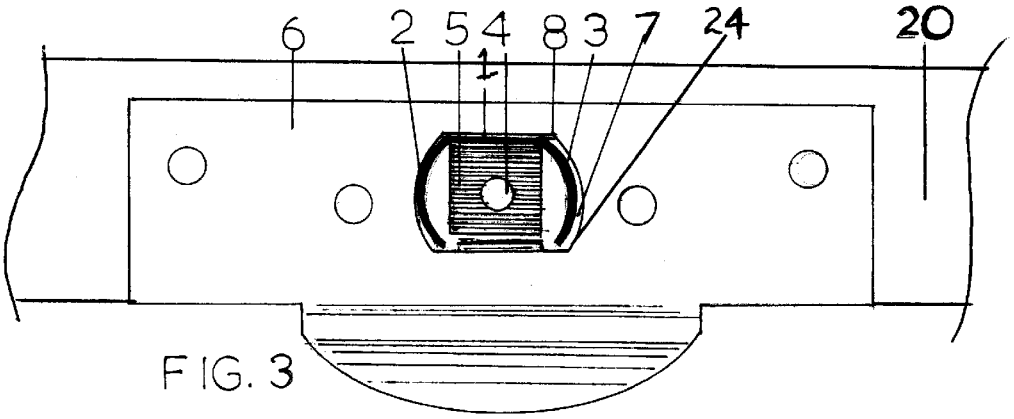
FIG. 3. Is a view of the sring bolt and strike plate guard mounted within the bolt cavity as seen when viewing the strike plate mounted on the door frame.

FIG. 3, shows a view of the spring bolt and strike plate guard (18) mounted within the bolt cavity (7) on the door frame (20) through the spring bolt aperture in the strike plate (6). Front plate (1) bears upon the outside edge (8) of the strike plate (6) aperture (24). The base section (5) sits on the bottom of the bolt cavity (7). Hole (4) is used to screw the spring bolt and strike plate guard (18) on to the door frame (20) at the bottom of the bolt cavity (7). Sides (2) and (3) are shown bearing upon the top and bottom edges of the bolt aperture (24) on the strike plate (6) in this view because the strike plate used has the smallest bolt aperture (24) which can possibly be used for a spring bolt.

With various other shapes and sizes of strike plate bolt apertures the side arms (2) and (3) can be bent further outwards, if necessary, to accomodate any variations in the geometry of the installation.

Figure 4:
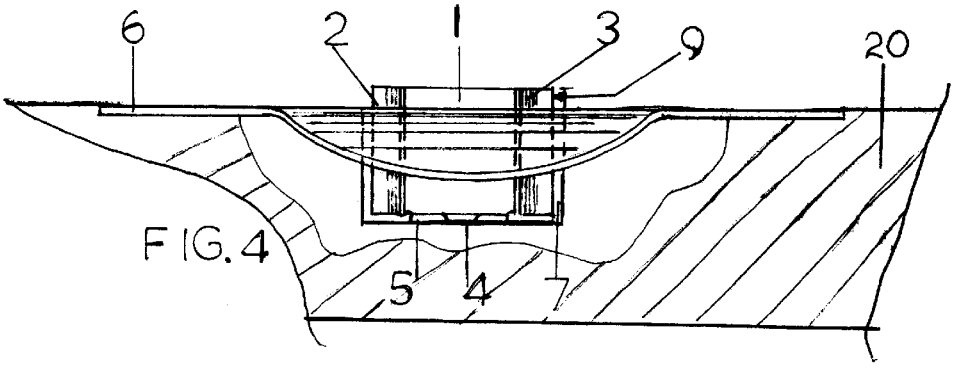
FIG. 4. Is a view of the spring bolt and strike plate guard mounted within the strike plate and showing the protrusion above the door frame which protrusion fills the door gap.

FIG. 4 shows a side elevation, as viewed from the inside edge of the door frame (20) on which the strike plate (6) has been mounted, with a section of the door frame (20) removed to show the bolt cavity (7) with the spring bolt and strike plate guard (18) mounted in place. The open section of the 'U' frame as shown in figures (3) and (4), that is the distance between the top of the curved arms (2) and (3), i.e., the top of the 'U', is the section through which the bolt passes when the door is being closed. This FIG. 4 view shows the protrusion (9), which is the section which protects the bolt from attack, whose protrusion length is set to match that distance between the strike plate (6) and the mounting plate (14) (FIG. 5) of the lock, nominally the door gap.

Figure 5:
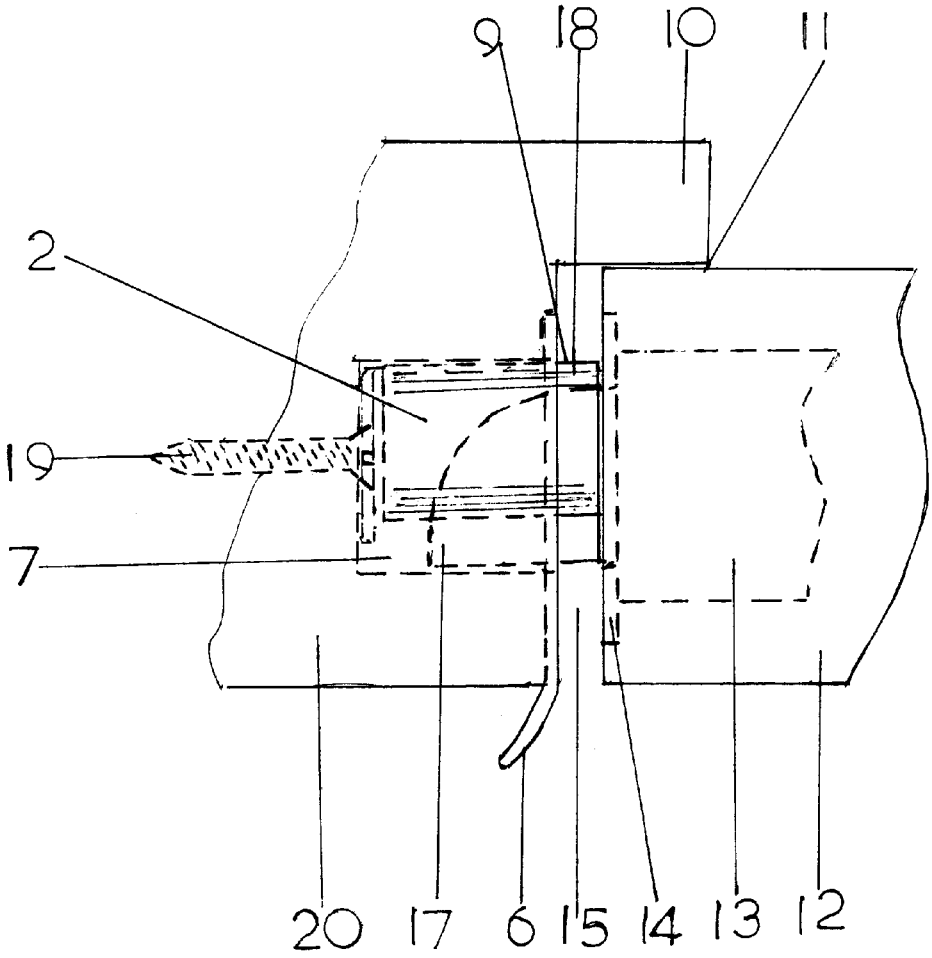
FIG. 5. Shows a plan view of the complete installation of the spring bolt and strike plate guard as seen from the top of the door.

FIG. 5, shows a complete installation of the spring bolt and strike plate guard (18) with reference to the frame (20) and the door (12). The strike plate (6) mounted on the door frame (20) covers the bolt cavity (7) drilled into the door frame (20). This bolt cavity (7) contains the spring bolt and strike plate guard (18) which is screwed to the bottom of the bolt cavity (7) by means of screw (19). Since this FIG. 5 is a plan view of the installation as viewed from the top of the door (12) only the upper curved arm (2) of the 'U' frame is showing. The spring bolt (17) which is normally held in its extended postion by the lock spring (not shown) strikes the strike plate (6) when the door is closing and then proceeds through the gap between the 'U' curved arms (2) and (3) before entering the bolt cavity (7) via the strike plate aperture (24). When some external body is inserted between the architrave (10) and the door (12) at point (11) and the door (12) is pushed in slightly the external body will enter the door gap (15) and bend towards the spring bolt (17). Since the spring bolt and strike plate guard (18) fills this door gap (15) by means of the protrusion (9) the external body cannot reach the spring bolt (17), and so cannot force the spring bolt back into the lock. Thus, the integrity of the spring bolt (17) is maintained.

Figure 6:
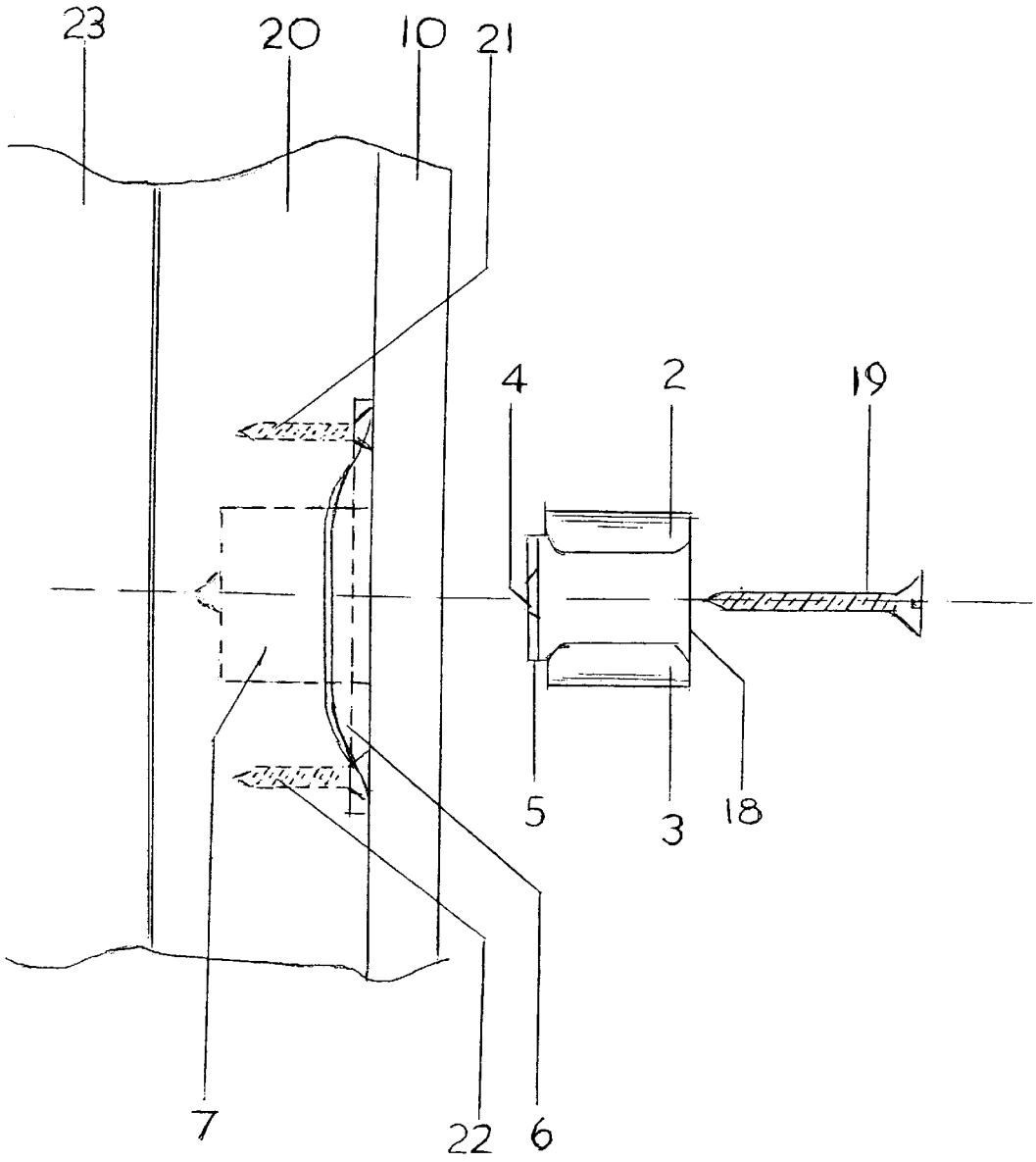
FIG. 6. Shows an elevation of the door frame with the strike plate mounted above the bolt cavity and the spring bolt and strike plate guard in the exact position for inserting into the bolt cavity via the strile plate aperture.

Referring to FIGS. 3 and 5 it can be seen that under external impact on the door the flat inner surface of the spring bolt (17) (FIG. 5) bears upon the innermost edge of the strike plate (6), aperture (24), such that the strike plate (6) tends to move inwards. This movement is blocked by the outermost edge of the spring bolt aperture (24) bearing upon the flat base (1) causing the curved 'U' arms (2) and (3) to bend inwards such that the lower ends of these curved 'U' arms (2) and (3) bear upon the base (5) of the spring bolt and strike plate guard (18). Thus, by this bending action, the initial linear impact force is redirected through 90° such that it is dissipated within the door cripple (23) (FIG. 6) rather than concentrating around the strike plate (6) retaining screws (21 and (22) (FIG. 6). In this manner the strike plate (6) integrity is maintained.

FIG. 6 shows a side elevation of the door frame (20), the archetrave (10) and the door cripple (23) and their relationship to the spring bolt and strike plate guard (18) with its retaining screw (19) prior to its insertion through the bolt aperture on strike plate (6) into the bolt cavity (7). Screw (19) extends through the door frame (20) into the door cripple (23).

What is claimed is:

1. A spring bolt and strike plate guard for preventing unauthorized entry through a door by reinforcing a strike plate of the door against impact and simultaneously protecting a spring bolt of the door from being accessed by burglary tools, the door being mounted to a door frame that defines a doorway, the door fame having a frame bolt cavity on one side thereof being formed by a blind bore in the door frame, the frame bolt cavity having an open end adjacent the doorway and a closed end inside the door frame, the frame bolt cavity receiving the spring bolt of the door upon closure of the door, the strike plate being attached to the door frame adjacent the open end of the frame bolt cavity, the strike plate having an aperture aligned with the open end of the frame bolt cavity that jointly receives the spring bolt with the frame bolt cavity upon closure of the door, the spring bolt and strike plate guard comprising:

a base mounted to the closed end of the frame bolt cavity, the base having a hole therein and mounted to the closed end of the frame bolt cavity using a screw extending through the hole in the base and into the door frame;

a front plate, integral with the base, extending along a wall of the frame bolt cavity in a direction perpendicular to the base, where the front plate and the base are joined at a juncture;

two curved flanges, integral with the front plate, extending from opposite sides of the front plate from each other in a direction perpendicular to the front plate along opposing walls of the frame bolt cavity, the curved flanges having proximal ends that join with the front plate and distal ends extending to a side of the frame bolt cavity opposite the proximal ends;

the front plate and the two curved flanges form a hollow U-shaped channel that receives the spring bolt upon closure of the door;

the front plate and the two curved flanges extending from the closed end of the frame bolt cavity to beyond the open end of the frame bolt cavity through the aperture in the strike plate to beyond the strike plate and protruding into the doorway to block access to the spring bolt by burglary tools through a gap between the strike plate and the door;

wherein the front plate and the two curved flanges prevent sliding motion of the strike plate wherein when the door is closed and the strike plate receives an impact from the spring bolt sufficient to cause the strike plate to slide on the door frame, an inside edge of the aperture of the strike plate is forced against the front plate of the spring bolt and strike plate guard thereby forcing the front plate to pivot about the juncture formed between the front plate and the base such that the distal ends of the curved flanges are forced into abutment with the base of the spring bolt and strike plate guard thereby transferring the impact on the strike plate into the door frame.

2. The spring bolt and strike plate guard of claim 1 wherein the spring bolt and strike plate guard is made of plastic.

3. The spring bolt and strike plate guard of claim 1 wherein the spring bolt and strike plate guard is made of metal.

* * * * *